United States Patent [19]

Okuno

[11] Patent Number: 4,987,290

[45] Date of Patent: Jan. 22, 1991

[54] ELECTRIC PANEL HEATER WITH UNIFORM EMISSIONS OF INFRARED RAYS AND WARM AIR

[75] Inventor: Tetsuya Okuno, Tokyo, Japan

[73] Assignee: Senju Metal Industry Co., Ltd., Tokyo, Japan

[21] Appl. No.: 321,131

[22] Filed: Mar. 9, 1989

[30] Foreign Application Priority Data

Mar. 11, 1988 [JP] Japan ..... 63-31547[U]

[51] Int. Cl.[5] ..... H05B 3/00; F23D 13/00; F24H 3/04; F24C 7/00

[52] U.S. Cl. ..... 392/375; 126/92 R; 239/553.3; 239/553.5; 392/435; 392/497

[58] Field of Search ..... 219/339–358, 219/365, 377, 530, 540, 344, 374, 381, 382; 239/553.3, 553.5; 126/92 R, 92 AC

[56] References Cited

U.S. PATENT DOCUMENTS

| | | | |
|---|---|---|---|
| 2,511,380 | 6/1950 | Stadler | 239/553.3 X |
| 3,736,095 | 5/1973 | Leatherby | 239/553.3 X |
| 3,996,025 | 12/1976 | Gulden | 239/553.3 X |
| 4,164,642 | 8/1979 | Ebert | 219/347 X |

FOREIGN PATENT DOCUMENTS

| | | | |
|---|---|---|---|
| 2203900 | 7/1973 | Fed. Rep. of Germany | 239/553.5 |
| 44-16225 | 7/1969 | Japan | 219/377 |
| 56-85619 | 7/1981 | Japan | 219/377 |
| 59-205531 | 11/1984 | Japan | 219/377 |
| 841913 | 7/1960 | United Kingdom | 219/377 |
| 2201320 | 8/1988 | United Kingdom | 219/377 |

*Primary Examiner*—Anthony Bartis

*Attorney, Agent, or Firm*—Sughrue, Mion, Zinn, Macpeak & Seas

[57] ABSTRACT

An infrared panel heater includes a housing having a gas inlet and a gas discharge opening covered by a porous metal panel. An electric heating element is disposed in the housing between the panel and the gas inlet for heating the panel for emission of infrared radiation therefrom. A plurality of spaced, parallel gas stream distributor plates are disposed in the housing between the heating element and gas inlet and are each provided with a plurality of openings forming the sole flow path for gas from the inlet to the discharge opening. The openings in each plate are uniform in diameter with the diameter of the openings in the respective plates decreasing as the plate is situated closer to the heating element so that a uniform gas distribution is achieved across the entire panel area. The outer surface of the panel may be coated with a porous ceramic infrared emitting layer. The center of the openings in adjacent plates are unaligned in the direction of gas flow and the total area of the openings in any one plate is equal to that of any other plate. The heating element may be in contact with the metal panel.

7 Claims, 4 Drawing Sheets

ELECTRIC PANEL HEATER WITH UNIFORM EMISSIONS OF INFRARED RAYS AND WARM AIR

BACKGROUND OF THE INVENTION

The present invention relates to an infrared heater which emits a warm gaseous fluid, such as warm air, and more particularly to an infrared heater which emits a warm gaseous fluid together with far-infrared rays having a wave length of 3 μm or longer for use in effecting reflowing of solder, curing of resins, drying of food, heating of wood and wet coatings, warming for medical treatment, and the like.

Recently, there is a general trend for electronic equipment to be made increasingly compact and lightweight. Accordingly, printed circuit boards having a large number of electronic parts mounted in a limited area (hereunder referred to as "high-density boards" or "high-density printed circuit boards") are widely used. In the manufacture of high-density boards, it is necessary to supply heat to a narrow area between electronic parts on the high-density board in order to reflow a paste solder or cure an adhesive resin when the electronic parts are connected to the circuit board using a paste solder or a resinous bonding agent. As an industrial heating apparatus for these purposes, a reflow furnace is used in which infrared heaters are placed on the top and bottom walls of a tunnel-type heating zone. The infrared heater used in the reflow furnace comprises a sheath heater, or else a simple heater supported by a steel plate. The wave length of the emitted radiation is not longer than 3 μm.

Since infrared rays travel in straight lines, the electronic parts on the high-density board prevent the infrared rays from directly reaching the areas where solder or adhesive resin was previously placed. Thus, sometimes the reflowing of a paste solder or the curing of a bonding agent is not sufficient to effect bonding of the electronic parts to the circuit board.

SUMMARY OF THE INVENTION

It has been in U.S. patent application Ser. No. 352,227 which has been assigned to the assignee of the present application, there has been disclosed an infrared heater which comprises an electric heating element installed in a box-type housing, a porous infrared-radiating member positioned over the heating element, and a gas-supplying means provided in the housing. Warm air together with infrared rays are emitted from a front panel of the porous infrared-radiating member. Due to the synergistic effect of warm air and infrared rays emitted therefrom, this type of infrared heater works satisfactory to carry out reflowing of a paste solder applied to usual printed circuit boards for use in household electric appliances and small-sized computers.

However, for large-sized printed circuit boards for use in super computers and the like it has been found that the above-mentioned infrared heater (hereunder referred to as the "preceding infrared heater") is not satisfactory in regards to its ability to achieve uniform heating of such large-sized circuit boards, which are usually 350 mm wide and 400 mm long.

This is because the preceding infrared heater cannot achieve uniform heating over the entire surface of the board, resulting in local overheating which causes thermal damage to electronic parts mounted on the board. In addition, sometimes paste solder in peripheral areas remains unmelted because of an insufficient level of heating.

An object of the present invention is to provide an infrared heater which can thoroughly heat narrow areas between electronic parts on high-density printed circuit boards, and which emits infrared rays which are easily absorbed by a paste solder or a boarding agent.

Another object of the present invention is to provide an infrared heater which can uniformly heat large-sized circuit boards for use in super computers and the like.

After investigating the cause of such non-uniform heating, the inventor found that the region of the porous panel of the preceding infrared heater from which warm air is blown is confined largely to the center of the panel, corresponding to the location of an air inlet of the housing. This is because the box-type housing of the preceding infrared heater is only provided with an inlet for a gaseous fluid (air) in its bottom or side walls. The flow of the gaseous fluid is not uniform within the housing, and therefore the flow rate of the warm gaseous fluid blown out of the porous front panel varies significantly over the surface of the panel.

FIG. 5 is a schematic sectional view of the preceding infrared heater in which the arrows indicate the flow of gas which is introduced into the box-type housing 1 through a gas inlet 8, heated by an electric heating element 3, and then blown out of the porous front panel 2. The longer the arrow the higher the flow rate of the gas. Thus, when the gas is introduced into the housing 1 from its bottom wall, the introduced gas is mainly blown out of the central area opposite the gas inlet 8. The flow rate of the gas in the peripheral areas which are distant from the center of the panel 2 is smaller.

The inventor has found that if the gas flowing into the housing of an infrared heater is uniformly dispersed within the housing, a uniform flow rate of warm gas from the front panel of the housing can be obtained.

Thus, the present invention resides in an infrared heater comprising an electric heating element installed in a housing, a porous infrared-radiating panel which is disposed in a gas discharge opening in the front of the housing and is positioned over the heating element, a gas-supply inlet provided in the housing through which a stream of gas can be supplied to the inside of the housing, and a plurality of stream-distribution plates provided within the housing to distribute the gas introduced through said gas supply inlet over the porous infrared-radiating panel.

The stream-distribution plates are provided for the purpose of uniformly distributing over the porous panel a stream of gas introduced into the housing through the gas inlet. The stream-distribution plates are not restricted to any specific type. So long as the plates can effectively achieve a uniform distribution of the discharged gas, any type of stream-distribution plates can be used.

For example, the stream-distribution plates may be plates having a plurality of slits, porous plates, or plates having punched holes. Preferably, from the standpoints of ease of manufacture and effectiveness the plates are provided with a plurality of through holes. A single plate may be used. However, the provision of a plurality of stream-distribution plates, and preferably three or more stream-distribution plates disposed in parallel with each other is advantageous because a plurality of parallel plates can more uniformly distribute the introduced gas to the porous front panel.

According to one embodiment of the present invention, a plurality of stream-distribution plates provided with a plurality of through holes are disposed in parallel. The number of holes in each plate increases and the diameter of each hole decreases as the plates become closer to the porous front panel. When an infrared heater of the present invention employs such an arrangement of stream-distribution plates, a highly uniform distribution of gaseous fluid can be efficiently achieved.

In addition, when the holes centers of the of adjacent plates are aligned with one another, the gaseous fluid passes straight through the housing without being dispersed laterally to any substantial extent. Therefore, it is desired that holes centers of the of adjacent stream-distribution plates not be in alignment with one another.

DESCRIPTION OF THE PREFERRED EMBODIMENTS

Figure 1:
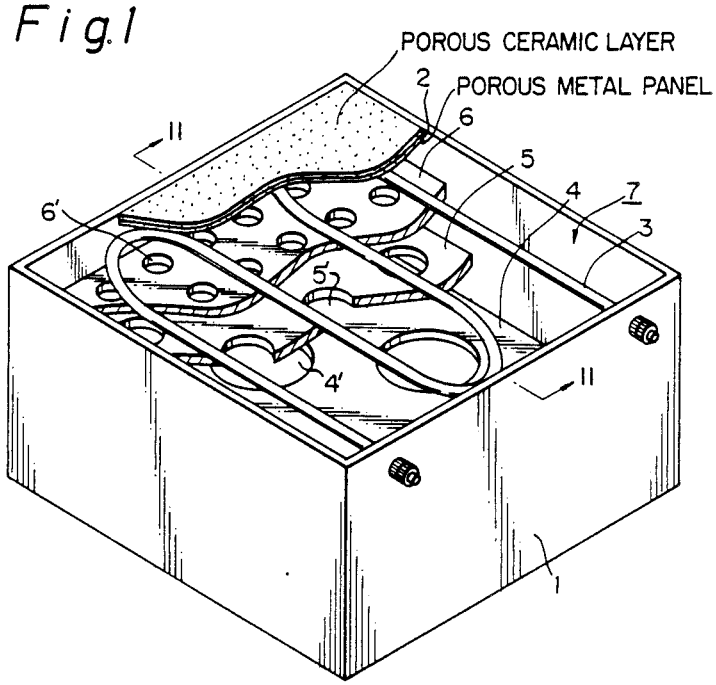
FIG. 1 is a cutaway perspective view of an infrared heater of the present invention.
Figure 2A:
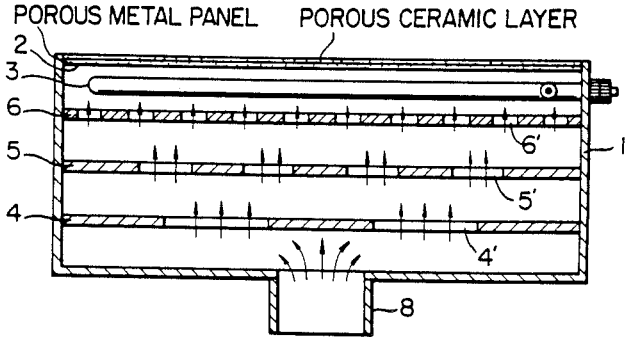
FIG. 2*a* is a cross sectional view taken along line A—A of FIG. 1.

FIGS. 1 and 2*a* show an embodiment of an infrared heater of the present invention which includes a box-shaped housing 1, a porous infrared-radiating panel 2, an electrical heating element 3, and a plurality of stream-distribution plates 4, 5, and 6.

The box-type housing 1 is provided with an upper gas discharge opening 7 through which a warm gaseous fluid such as warm air is blown. The warm gaseous fluid will hereunder be referred to simply as "warm air". A gas inlet 8 is provided on the bottom of the housing 1. The upper opening 7 is covered with the porous infrared-radiating panel 2 which is in the form of a plate.

The porous infrared-radiating panel 2 may be made of any material which can emit infrared rays and preferably far-infrared rays when heated and which allows the passage of a gaseous fluid therethrough. Examples of a suitable porous infrared-radiating panel 2 are a porous sintered metal plate which is produced by sintering metal powders, a perforated metal plate manufactured by electroforming (commercially available under the tradename of "Celmet"), a punched metal plate which is manufactured by mechanically punching a large number of holes in a metal plate, or the like. A ceramic layer may be placed on such metal plates so that they can emit infrared rays, and particularly far-infrared rays when heated. A ceramic layer which can emit far-infrared rays when heated can be made of $Al_2O_3$, $TiO_2$, $Cr_2O_3$, MgO, $ZrO_2$, $SiO_2$, and the like. The ceramic layer can be manufactured by means of baking or flame spraying a ceramic onto a porous metal plate.

In a preferred embodiment, in light of its function as an infrared-radiating element, the porous infrared-radiating panel comprises a perforated metal plate manufactured by electroforming and a ceramic layer which is applied thereto by flame spraying. According to this embodiment, the surface area of the panel which can emit infrared rays is large and it can emit a large number of far-infrared rays. Therefore, paste solder can be heated and melted rapidly upon being heated with minimum thermal damage to electronic parts on a printed circuit board.

Figure 2B:
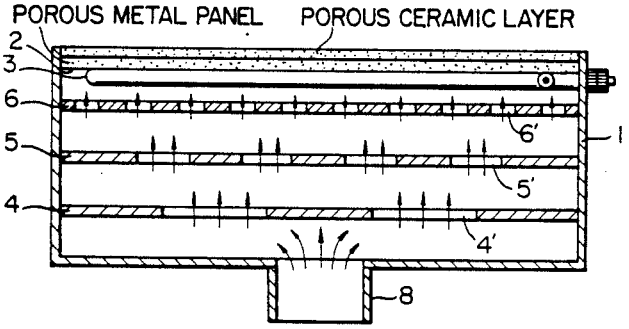
FIG. 2*b* is a cross sectional view similar to FIG. 2*a* showing a another embodiment of the invention.

An electric heating element 3 is disposed behind the porous panel 2 and may be in contact therewith as shown in FIG. 2*b*. Below the heating element 3, a plurality of stream-dispersion plates 4, 5, and 6 are disposed in parallel with one another at appropriate intervals.

Figure 3A:
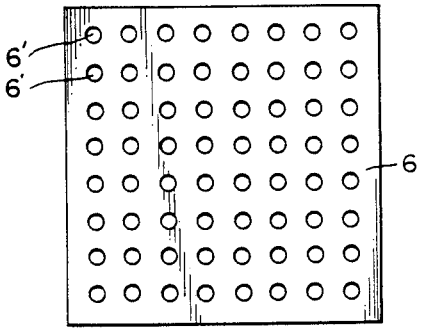
FIGS. 3*a*, 3*b*, and 3*c* are plan view of three different stream-distribution plates which vary in the number and diameter of the holes formed therein.
Figure 3B:
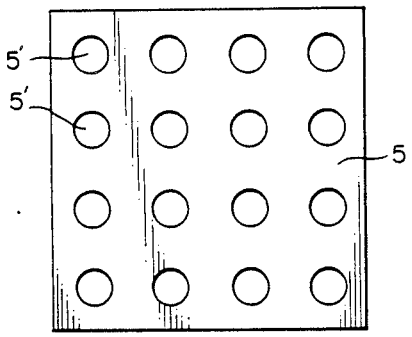
Figure 3C:
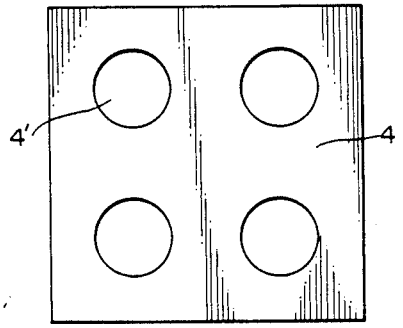

Each stream-dispersion plate has a plurality of through holes or slits formed therein. As shown in FIGS. 3*a*~3*c*, the number of holes 4′ (four, for example) formed in the lowermost plate 4 is the smallest, but the diameter of each hole is the largest. An intermediate plate 5 has a larger number of through holes 5′ (sixteen, for example) having a smaller diameter than the through holes 4′ of the bottom plate 4. The uppermost stream-distribution plate 6 has the largest number of through holes 6′ (sixty-four, for example) which have a smaller diameter than do the through holes 5′.

Figure 4:
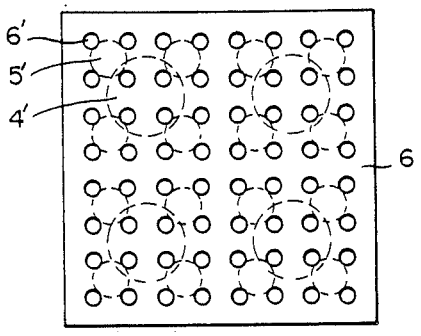
FIG. 4 is a schematic plan view showing an arrangement of through holes of a plurality of stream-distributed plates.
Figure 5:
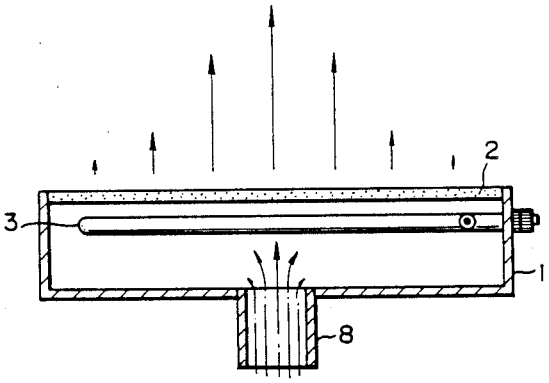
FIG. 5 is a schematic sectional view of the preceding infrared heater in which streams of gas are indicated by arrows.

The three stream-dispersion plates 4, 5, and 6 are disposed within the housing 1 in such a manner that the through centers of the holes of adjacent plates are not aligned in the vertical direction. Namely, as shown in FIG. 4, the centers of the holes 4′ of the bottom plate 4 are not aligned with the holes 5′ of the middle plate 5. Furthermore, these holes 4′ and 5′ are arranged so as not to substantially overlap with each other. The same applies to holes 5′ and holes 6′.

In the illustrated embodiment, the radii of through centers of the holes 4′, 5′, and 6′ are chosen such that the total area occupied by the through holes is the same for each plate. Thus, the radii of through holes 5′ is one-half the radii of through holes 4′, and the radii of through holes 6′ is one-half the radii of through holes 5′. With this arrangement, gas will flow through the housing 1 at a constant speed. However, it is possible to have the radii of the through holes vary in a different manner so as to obtain a desired flow rate.

The gas inlet 8 which is provided in the bottom of the housing 1 is connected with an unillustrated gas supply device such as an air-compressor, blower, and high-pressure gas cylinder. A gaseous fluid in the form of air and an inert gas such as nitrogen, carbon dioxide, argon, or helium may be supplied to the housing 1 through the inlet 8.

The operation of the infrared heater of the present invention will be described with reference to the drawings.

A gaseous fluid, such as air and an inert gas which is introduced into the housing 1 through the inlet 8 is first distributed within the housing through the holes 4′ provided in the lowermost stream-distribution plate 4. Then, the dispersed gas enters a plurality of the holes 5′ of the middle plate 5 to be further dispersed. When passing through the holes 6′ of the uppermost plate 6, the pressure of the gas is substantially uniform over the entire the plate 6. The uniformly dispersed gas is then heated by the electric heater 3 and then is discharged from the front porous panel 2.

The electric heater 3 can heat not only the gas but also the porous panel 2. Therefore, the heated ceramic layer emits infrared rays, preferably far-infrared rays, so both infrared rays and heated gas are discharged from the front porous infrared-radiating panel 2. Due to the synergistic effect of the heated gas and the infrared rays, the heater of the present invention can heat printed circuit boards rapidly, efficiently, and uniformly. When a heater of the present invention having a front panel measuring 400×480 mm is used, large-sized circuit boards measuring 580×600 mm can be rapidly and uniformly heated without any substantial thermal damage to electronic parts on the board.

The present invention has been described primarily with respect to an example in which the infrared heater of the present invention is used as a heat source in a reflow furnace. However, as is apparent from the foregoing, the heater of the present invention is useful for a variety of other applications, including curing of resins, drying of food, heating of wood and wet coatings, and warming for medical treatment.

I claim:

1. An infrared panel heater comprising:

a housing having a gas inlet and a gas discharge opening;

a porous panel which can emit infrared radiation when heated and which covers the gas discharge opening;

a heating element which is disposed inside said housing to the rear of said porous panel; and a plurality of gas stream-distribution plates which are disposed inside said housing between the gas inlet and said heating element in parallel spaced stacked relationship, each of said gas stream-distribution plates having a plurality of openings formed therein through which a gas can flow transversely, with said openings formed the sole path for the gas from the inlet to the discharge opening, where the openings in each plate are so sized, shaped and distributed and the area of the openings for each plate decreasing in size as the plate are situated closer to the heating element, so that a uniform distribution of gas flow is achieved across the entire area of the porous panel.

2. An infrared heater as claimed in claim 1, wherein the number of openings in each gas stream-distribution plate increases the closer the stream-distribution plate is to the gas discharge opening of said housing.

3. An infrared heater as claimed in claim 2, wherein the total area defined by the openings in any one of said stream-distribution plates is the same as for any other of said stream-distribution plates.

4. An infrared heater as claimed in claim 1, wherein the center of the openings of immediately adjacent gas stream-distribution plates are not aligned in the direction of gas flow through said gas stream-distribution plates.

5. An infrared heater as in claim 1, wherein said porous panel is a porous metallic sheet having formed thereon a porous ceramic layer on its outer surface which can emit infrared rays when heated.

6. An infrared heater as claimed in claim 5, wherein said heating element is in contact with the inner surface of said porous panel.

7. An infrared heater as claimed in claim 1, wherein the total area defined by the openings in any one of said stream-distribution plates is the same as for any other of said stream-distribution plates.

* * * * *